United States Patent [19]

DeMarco et al.

[11] Patent Number: 4,460,087

[45] Date of Patent: Jul. 17, 1984

[54] CORE PLUG

[75] Inventors: Richard E. DeMarco, Waldwick, N.J.; David Hopkins, Wilton, Conn.; Walter D. McVicar, Bedford Village, N.Y.

[73] Assignee: Westvaco Corporation, New York, N.Y.

[21] Appl. No.: 431,271

[22] Filed: Sep. 30, 1982

[51] Int. Cl.[3] ..... B65D 39/00

[52] U.S. Cl. ..... 206/415; 220/284; 220/285; 220/307

[58] Field of Search ..... 220/284, 285, 286, 307; 206/415

[56] References Cited

U.S. PATENT DOCUMENTS

| | | | |
|---|---|---|---|
| 1,492,248 | 4/1924 | Hachmann | 220/284 |
| 1,719,224 | 7/1929 | Haase | 220/284 |
| 1,871,907 | 8/1932 | Olt | 220/307 |
| 1,899,565 | 2/1933 | Gredeil | 220/284 |
| 1,905,653 | 4/1933 | Schranz | 220/307 |
| 3,046,853 | 7/1962 | Legendre | 220/284 |
| 3,396,269 | 8/1968 | Sorenson | 220/307 |
| 3,674,295 | 7/1972 | Padovani | 220/307 |
| 4,303,176 | 12/1981 | Swartzbaugh | 220/307 |

*Primary Examiner*—Joseph Man-Fu Moy

[57] ABSTRACT

A solid core plug formed from wood, plastic, or a composite molded wood material having a substantially cylindrical shape with a body portion and an integral tapered forward portion. The core plug may include a single, tapered ridge element on the outer surface of the body portion for accomodating cores having varying internal diameters within a given nominal size; a core plug removal opening located at its outer surface for increased strength; and, an integral ramp surface and recessed area in the end thereof for accomodating a curved bar removal tool.

4 Claims, 8 Drawing Figures

15
17
14
19
16
18
10
11
12
13
16

10
14
22
23

15
18
19
21
20
16

15
18
19
17
21
20
16

CORE PLUG

BACKGROUND OF INVENTION

The present invention relates generally to an improved core plug, and more particularly to a solid core plug formed from wood, plastic or a composite woody material that may include one or more novel features. These features include a means for increasing the strength of the core plug; an improved means for facilitating removal of the core plug from a core; and, a means for adapting the core plug to cores of varying size.

Solid core plugs such as the molded wood core plugs available from Moldwood Corporation, York, Ala. 30925 and from Souhegan Wood Products, Inc., Wilton, NH. 03086 are conventional in design with a centrally located hole for removing the core plugs from cores. In addition, because the fiberboard cores in which the core plugs are used are produced in various sizes, each with minor variations, the core plugs must be manufactured in a variety of sizes with some means for accomodating the minor variations within a given size. The latter requirement presents manufacturing problems for the maker and inventory problems for the user of the core plugs. Moreover, the placement of the core plug removal hole at the center of the core plug has been found to be the least desirable location as regards the strength of the core plug and also presents some problems with core plug removal, especially when working with the longer core sizes.

Core plug manufacturers have attempted to deal with the problems encountered where there are minor variations in a nominally sized core in different ways. One technique employed in the past to overcome this situation has been to provide axially extending ribs or splines on the outer surface of the body portion of the core plug which is inserted into the core. These splines are generally of sufficient height to fit tightly even into the largest core of a given nominal size, and in the case of the smaller core diameters, the core will deform or the splines will partially flatten thus allowing the core plugs to enter the core. This technique is not entirely satisfactory however, because it depends upon either the resiliency of the core material or the core plug itself in order to be successful. U.S. Pat. Nos. 1,919,769 and 3,627,220 show two examples of such core plugs where the plugs are made from plastic or metal and include evenly spaced projections around the periphery of the plug. In the case of solid wood or molded wood plugs, Souhegan Wood Products adds uniformly spaced ridges around the outer surface of its core plugs in selected sizes and also produces several different core plugs of slightly varying size within a given nominal size. Nevertheless, the problem of accomodating all cores within a given nominal size remains.

With regard to the removal of such core plugs, it has been the practice in the past to use a bar or rod of greater length than the longest core expected to be encountered. With the conventional center hole plugs, the bar or rod is inserted in the hole in the core plug at one end of the core and butted against the inside of the core plug at the other end of the core so it can be driven out. This technique works well with cores that are not too long. However, the length of bar material necessary for longer cores presents a problem particularly when working in close quarters. Thus there has been a need for developing a better means for removing such core plugs from the ends of cores.

Finally, it has been demonstrated, particularly as disclosed in pending U.S. patent application Ser. No. 270,413, filed June 4, 1981 and assigned to the present assignee herein, that locating the core plug removal opening at the center of the core plug yields the least desirable ultimate crush strength of the core plug. This is particularly important where the rolls are subjected to severe usage and handling, as for instance in rail shipments where the rolls are loaded in rail cars and the cars are switched from one engine or place to another. Accordingly, there remains the universal problem of producing the core plug in such a manner that it may achieve maximum strength.

The present invention provides a means for overcoming each of the aforementioned problems by using one or more of the novel improvements disclosed herein.

SUMMARY OF INVENTION

The present invention relates to an improved core plug made from wood, plastic, or a composite woody material. The core plug of the invention comprises a solid body portion with an integral tapered forward portion of substantially cylindrical shape. The outer face of the body portion has a diameter that is substantially equal to the nominal size of the inside diameter of the core for which the core plug is intended. Meanwhile, the inner face of the forward portion of the core plug is of slightly less diameter than the outer face to facilitate entry of the core plug into the end of a core.

In order to permit the core plug of the present invention to fit tightly into several different cores of slightly varying size within a given nominal size, the outer face of the body portion of the core plug includes no more than one tapered ridge member. The single ridge core plug is produced with a diameter equal to the smallest core size expected to be encountered within a given nominal size and the ridge height is sized to fit the largest diameter core expected within that nominal size. When inserted in a core having a notched metal cap or insert, the core plug is rotated so that the ridge is aligned within the notch provided in the metal cap or insert. When used with normal uncapped cores, the core plug is rotated so that the ridge is non-aligned with the notch, but engages the inside of the core to hold it securely. This arrangement benefits the user because only one plug is required for each nominal core diameter, reducing the required inventory of sizes by at least 50%. The manufacturer benefits also since his investment in plug manufacturing equipment is reduced by a factor as much as four (4), and the utilization of equipment is higher. The single ridge may be applied to conventional center hole core plugs or other core plug styles as disclosed herein.

In order to provide increased strength for the core plug of the present invention, the core plug removal opening may be moved away from center substantially as disclosed in pending U.S. patent application Ser. No. 270,413, filed June 4, 1981 entitled "Core Plug". Moving the core plug removal opening away from center to a position at or near the remote outer surface of the core plug body increases the crush strength by as much as three fold in certain instances. In the preferred embodiment, the core plug removal opening is formed as a groove in the outer surface of the core plug. The groove has a substantially flat bottom surface with straight or slightly curved side walls. For molded wood plugs, the groove must have a shape that will permit the plug to be easily removed from the mold.

Finally, in order to facilitate the removal of the core plug of the present invention from its core, the core plug may be provided with a ramped surface incorporated into the core plug removal hole or groove located at the forward portion of the core plug. The ramped surface can be provided in both center hole plugs or edge hole plugs. In any event, the ramped surface is intended to cooperate with a curved bar plug removal tool that utilizes leverage to remove the core plug rather than the preferred conventional means of knocking the plug out of one end of the core by extending a bar or rod completely through the core. For this purpose, the core plug whether it is a center hole model or a side hole model is provided with a ramped surface at the forward end thereof which extends between the plug removal hole or groove to a recessed area in the face of the core plug. The curved bar is designed to fit within the plug removal hole and extend across the ramped surface where the end of the bar abuts the recessed area at the forward end thereof. The bar also preferably includes an integral fulcrum member which may rest against one end of the core. In this manner the bar may be lifted in normal fashion so that the curved end thereof rotates about the fulcrum member to wedge the core plug out of the end of the core. A typical curved bar core plug removal tool is fully disclosed in pending U.S. design patent application Ser. No. 356,761, filed Mar. 10, 1982 entitled "Core Plug Removal Tool", and assigned to the present assignee herein.

Accordingly, it is an object of the present invention to provide an improved core plug for protecting the ends of hollow paperboard or fiberboard cores, with plain or reinforced ends, on which paper, plastic, fabric and other sheet materials may be wound for storage, shipment and use.

Another object of the present invention is to provide a core plug is enhanced strength that is the result of the relocation of the core plug removal hole from the traditional center location to a location remote from the center of the core plug and preferably at an outer peripheral surface thereof.

A further object of the present invention lies in the provision of only a single tapered ridge along the outer surface of the body portion thereof which enables a single core plug of a given nominal size to fit snugly within the ends of core plugs with varying internal dimensions within the given nominal size.

Still another object of the present invention resides in the provision of a ramped surface in conjunction with the core plug removal opening which permits the use of a curved bar removal tool in facilitating the removal of the core plugs from the ends of cores.

The core plug of the present invention is preferably made of wood, plastic or a composite woody material in a mold or the like. An example of a composite woody material is molded wood which may be defined as a composition of wood shavings, chips or sawdust, resins and/or glue which is mixed together and heated under pressure in a mold to produce the desired shape.

Other and further objects will become apparent from a consideration of the following detailed description taken with the accompanying drawing.

DETAILED DESCRIPTION

Figure 1:
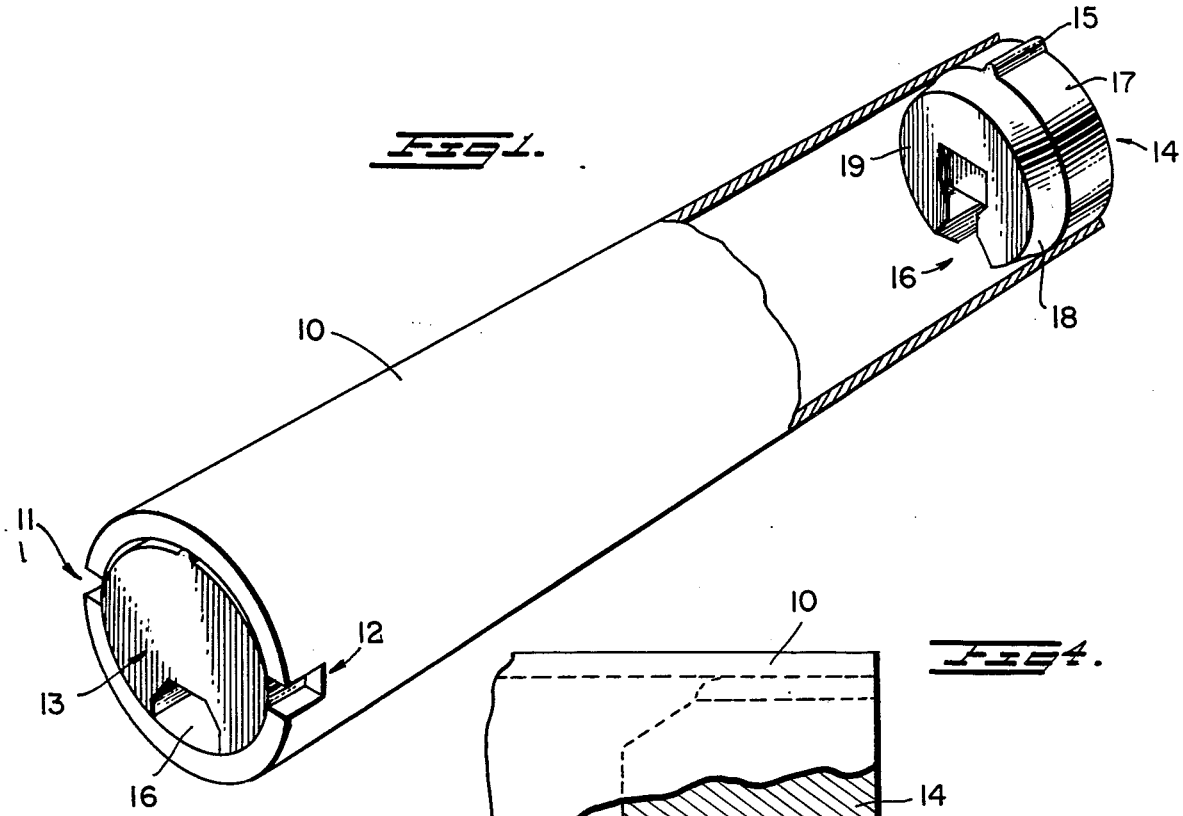
FIG. 1 is a perspective view with one end in section showing a tubular fiberboard core with each end reinforced with core plugs made according to one embodiment of the present invention.
Figure 4:
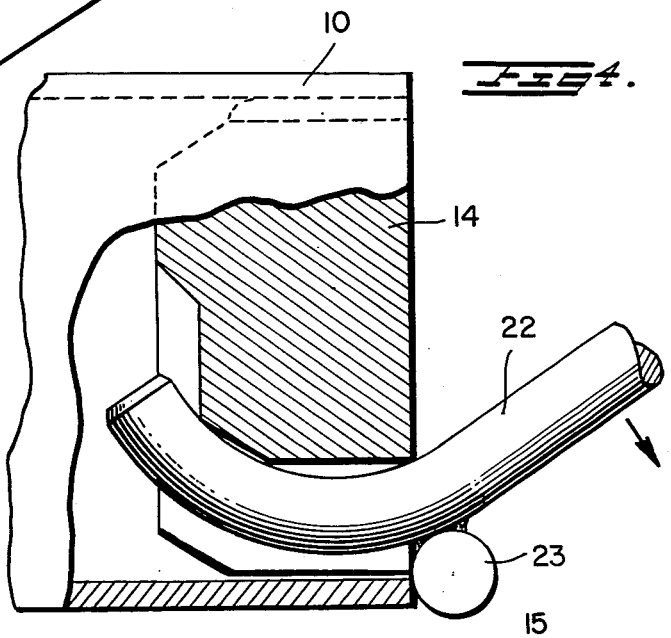
FIG. 4 is a side view showing the core plug inserted in the end of a core with a core plug removal tool in position to remove the core plug.

As shown in FIG. 1, an elongated paper core 10 is illustrated with end notches 11 and 12 at each end thereof and a pair of core plugs 13,14 inserted in each end. These core plugs 13,14 are of substantially solid construction, prepared from wood or a molded wood composite, but may be fabricated from another material such as a plastic compound where cost is no object. Each core plug 13,14 is provided with a single tapered ridge element 15 that is preferably located directly opposite a core plug removal opening or groove 16 located near the outer surface thereof. The core plug has a solid cylindrical body portion 17 that in combination with the single ridge element 15 permits the core plug to fit tightly into the end of a core 10. The core plug also includes an integral tapered forward portion 18 that tapers down to a front face 19 for facilitating entry of the core plug into a core. The outer face of the body portion 17 is formed with a diameter equal to the smallest core expected to be encountered within a given nominal size and the ridge element 15 is sized to fit snugly within the largest core expected to be encountered within a given nominal size. When the core plug is used with the smaller cores within the given nominal core size, the ridge 15 is positioned to be aligned with one of the core notches 11,12. For the larger size cores, the ridge 15 is positioned substantially as shown in FIG. 1.

Figure 2:
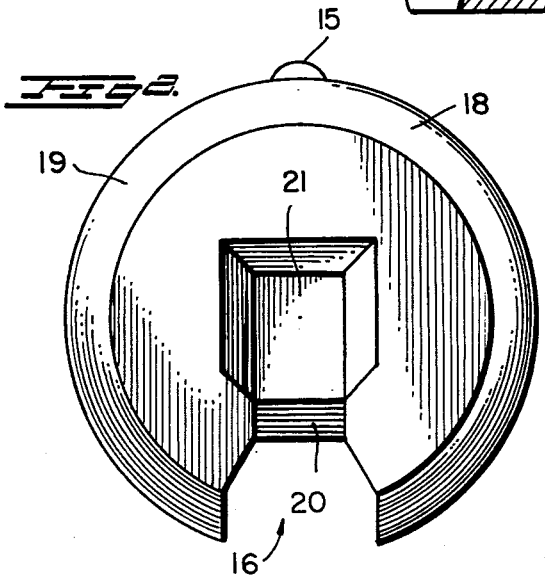
FIG. 2 is an end view of the inner face of the forward portion of a core plug according to the present invention.
Figure 3:
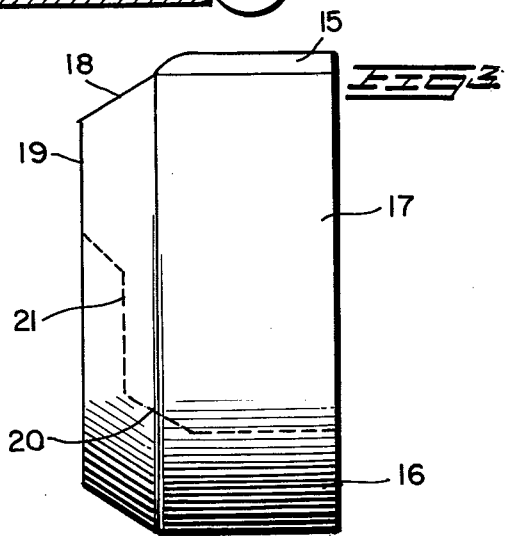
FIG. 3 is a side view of the core plug of FIG. 2.
Figure 5:
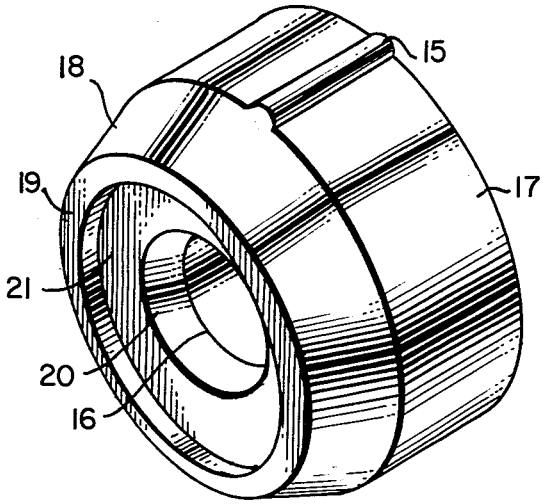
FIG. 5 is a perspective view of a modified core plug according to the present invention.
Figure 6:
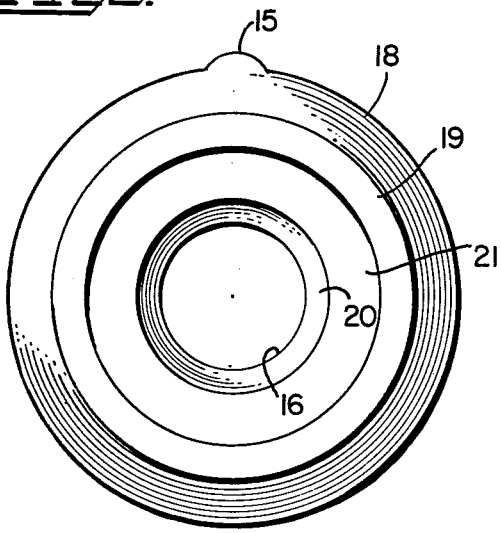
FIG. 6 is an end view of the inner face of the forward portion of the modified core plug of FIG. 4.
Figure 7:
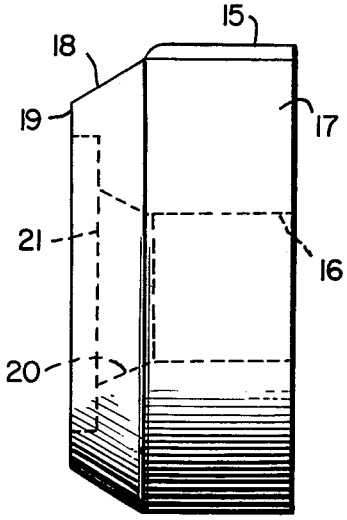
FIG. 7 is a side view of the core plug of FIG. 5.

The core plug includes a core plug removal opening or groove 16 spaced from the center thereof at an outer peripheral surface which extends the full length of the core plug. Where the core plugs are molded, the opening or groove may be molded in place. The groove 16 includes an integral ramped surface 20 at its forward end and a recessed area 21 in the face 19 thereof for accomodating a curved bar removal tool 22 with an integral fulcrum element 23 substantially as shown in FIG. 2. The shape of the groove 16 is not particularly significant but must be designed so that a molded plug may be easily removed from its mold during manufacture.

FIGS. 5–8 illustrate a second embodiment of the present invention wherein two of the novel features of the present invention are applied to a center hole plug. In this case, like reference numerals are applied to like parts in the first embodiment of the invention.

Figure 8:
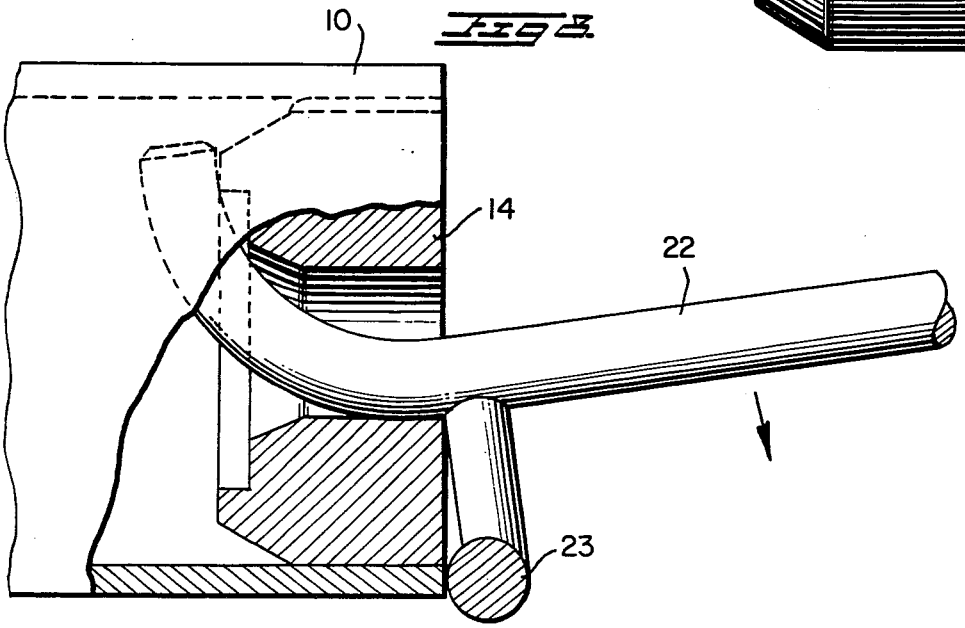
FIG. 8 is a side view showing the core plug of FIG. 5 inserted in the end of a core with a core plug removal tool in position to remove the core plug.

The core plug shown in FIGS. 5–8 includes a body portion 17 with a single ridge element 15, a tapered forward portion 18 extending to a front face 19. The front face 19 includes a recessed area 21 and a ramp surface 20 that extends completely around the core plug removal opening 16. FIG. 8 illustrates the core plug inserted in the end of a core 10 with a core plug removal tool 22 in position to remove the core. It will be seen that the end of the core plug removal tool fits easily within the recessed area 21 of front face 19 while the curved section follows the contour of the ramped surface 20. The core plug removal tool 22 includes a fulcrum element 23 that abuts against the end of the core for prying the core plug from the core.

It will thus be seen that the core plug of the present invention may include one or more novel features to produce a final product that solves many of the problems experienced with prior art core plugs. Accordingly, even though the detailed disclosure set forth above describes only two embodiments of the invention, it is obvious that modifications and variations may be made by those skilled in the art within the limitations of the claims which follow.

We claim:

1. A single ridge core plug for reinforcing and preventing damage to the ends of hollow, tubular cores having varying internal diameters within a given nominal size and on which webs of paper, plastic, fabric and other material may be wound, said core plug comprising, a solid elongated cylindrical body formed from wood, plastic or a composite woody material having sufficient strength to absorb the impact shocks and crushing loads experienced by the core ends during handling and shipping said cylindrical body having an outside diameter substantially equal to the inside diameter of the smallest core expected to be encountered within a given nominal size, an integral tapered forward portion for facilitating entry of the core plug into the core, a single tapered ridge element located on the outer peripheral surface of said cylindrical body extending from the forward portion of the core plug along the elongated axis to the rear thereof and having a height sufficient to permit the core plug to fit snugly into the largest core expected to be encountered within a given nominal size, and means for removing the core plug from the cores after shipment, said means comprising a core plug removal opening extending the full length thereof and having a size adapted to accommodate a core plug removal tool, a recessed area at the forward end of said core plug adjacent to the core plug removal opening and a ramped surface connecting said core plug removal opening with said recessed area.

2. The core plug of claim 1 wherein said core plug removal opening is in the form of a groove located in the outer peripheral surface of said core plug.

3. In combination, a hollow tubular core selected from a group of hollow tubular cores having varying internal diameters within a given nominal size and on which paper, plastic, fabric and other sheet materials may be wound and a core plug for reinforcing and protecting the ends of the core from damage during handling and shipping, said tubular core including notches in the ends thereof for chucking, said core plug comprising a solid elongated cylindrical body portion and an integral forward portion that tapers down to a front face of lesser diameter than said body portion for facilitating entry of the core plug into the core ends, said core plug body portion including a single tapered ridge element on the outer peripheral surface thereof extending from the forward portion of the core plug along the elongated axis to the rear thereof, and a core plug removal opening extending the full length thereof, said core plug body portion having an outside diameter substantially equal to the inside diameter of the smallest core expected to be encountered within a given nominal core size with said ridge element aligned within one of the notches of the core, and said ridge element having a height such that it will permit the core plug to fit snugly into the largest core expected to be encountered within a given nominal core size with said ridge element being non-aligned with the notches in said core, said core plug removal opening having a size adapted to accommodate a core plug removal tool and including a recessed area at the front face thereof adjacent to said core plug removal opening and a ramped surface connecting said core plug removal opening with said recessed area.

4. The core plug of claim 3 wherein said core plug removal opening is in the form of a groove located in the outer peripheral surface of said core plug.

* * * * *